United States Patent [19]

Van Rijen et al.

[11] Patent Number: 4,624,078

[45] Date of Patent: Nov. 25, 1986

[54] SURFACE SANDER

[75] Inventors: J. G. Van Rijen, Prinsenbeek; Jan P. Houben, Breda, both of Netherlands

[73] Assignee: Skil Corporation, Breda, Netherlands

[21] Appl. No.: 660,281

[22] Filed: Oct. 12, 1984

[30] Foreign Application Priority Data

Oct. 17, 1983 [NL] Netherlands ..... 8303577

[51] Int. Cl.[4] ..... B24B 23/00

[52] U.S. Cl. ..... 51/170 MT; 51/273; 51/382

[58] Field of Search ..... 51/170 MT, 170 TL, 170 R, 51/273, 382, 358, 384, 386, 391, 392

[56] References Cited

U.S. PATENT DOCUMENTS

| | | | |
|---|---|---|---|
| 2,764,852 | 10/1956 | Emmons | 51/170 MT |
| 2,786,313 | 3/1957 | Shaff . | |
| 3,543,449 | 12/1970 | Scott et al. . | |
| 3,938,283 | 2/1976 | Keith | 51/170 TL |
| 4,381,628 | 5/1983 | Dicke | 51/170 TL |
| 4,475,317 | 10/1984 | Dicke | 51/170 MT |

FOREIGN PATENT DOCUMENTS

| | | |
|---|---|---|
| 2058978 | 5/1971 | France . |
| 8303180 | 9/1983 | Netherlands . |
| 2104647A | 3/1983 | United Kingdom . |

*Primary Examiner*—Roscoe V. Parker

*Attorney, Agent, or Firm*—Birch, Stewart, Kolasch & Birch

[57] ABSTRACT

A surface sander having a housing with a handle and a motor with a motor shaft arranged in a bearing of a sanding foot which is connected through a flexible body with the housing, is disclosed. A dust hood encloses the motor, the housing, the flexible body and the sanding foot. Two parts of the hood are mutually lockable, and the flexible body has an upper annular rim which can be clamped between a bottom rim of the motor housing and the dust hood parts. A lower annular rim is fastened to the sanding foot and a number of spring strips connects the upper annular rim to the lower annular rim, so that the sanding foot can be mounted on the machine in a simple manner by the dust hood without the need for additional fastening devices.

15 Claims, 5 Drawing Figures

SURFACE SANDER

The present invention relates to a surface sander comprising a housing having a handle and a motor with a motor shaft arranged in the housing, the end of which is eccentrically arranged in a bearing of a sanding foot, which is connected by flexible means with the housing.

The present invention has for its object to improve a surface sander with respect to dust extraction, mounting and manipiability in a manner such that the cost of the machine is minimized.

The surface sander according to the present invention is characterized in that a dual dust hood encloses the motor housing, the flexible means and the sanding foot, and the two parts of the hood are mutually lockable.

The dust hood proposed by the present invention provides, apart from the advantage of effective dust extraction, the possibility of serving as a mounting means.

For this purpose the surface sander of the present invention is furthermore characterized in that the flexible means comprises an annular body which can be clamped between the bottom rim of the motor housing and the dust hood parts.

Thus the sanding foot can be mounted on the machine in a simple manner by the dust hood without the need for additional fastening means.

Preferably the flexible means each have a peripheral part connected by a number of spring strips with the annular body, which part can be connected with the sanding foot. In this embodiment of the present invention the annular body, the spring strips and each peripheral part may be integrally manufactured, for example, by spray-casting, which results not only in low manufacturing costs, but also low mounting costs. Moreover sufficient movability of the sanding foot with respect to the housing is ensured.

When the sanding foot of the sander is provided at opposite ends with fastening means for the sanding strip to be secured to the present foot, the invention proposes to provide each member with one or more tags for clamping the peripheral part of the flexible means to the sanding foot. Thus the fastening means can be mounted on the sanding foot simultaneously with the flexible means, which contributes to the low mounting costs.

In a preferred embodiment each fastening member is formed by a pair of resilient clamping jaws between which a spreading body is operative for opening the jaws.

According to the invention each hood part is provided with a window through which the present spreading body can be passed so that the spreading bodies are accessible from the outside of the dust hood.

Apart from the conventional ventilator for cooling the motor the motor shaft is equipped within the range of the dust hood with a second ventilator for dust extraction. It may then be preferred to provide an outlet port in the dust hood for the dust at the level of the second ventilator.

In order to compensate for the imbalance in the sanding foot the impeller of the second ventilator is provided with a counterweight.

In order to ensure a dynamic balancing in addition to the aforesaid static balancing the impeller is furthermore provided with a second counterweight set off with respect to the above-mentioned counterweight in a radial plane.

The present invention will become more fully understood from the detailed description given hereinbelow and the accompanying drawings which are given by way of illustration only, and thus are not limitative of the present invention, and wherein:

The drawing shows in:

Figure 1:
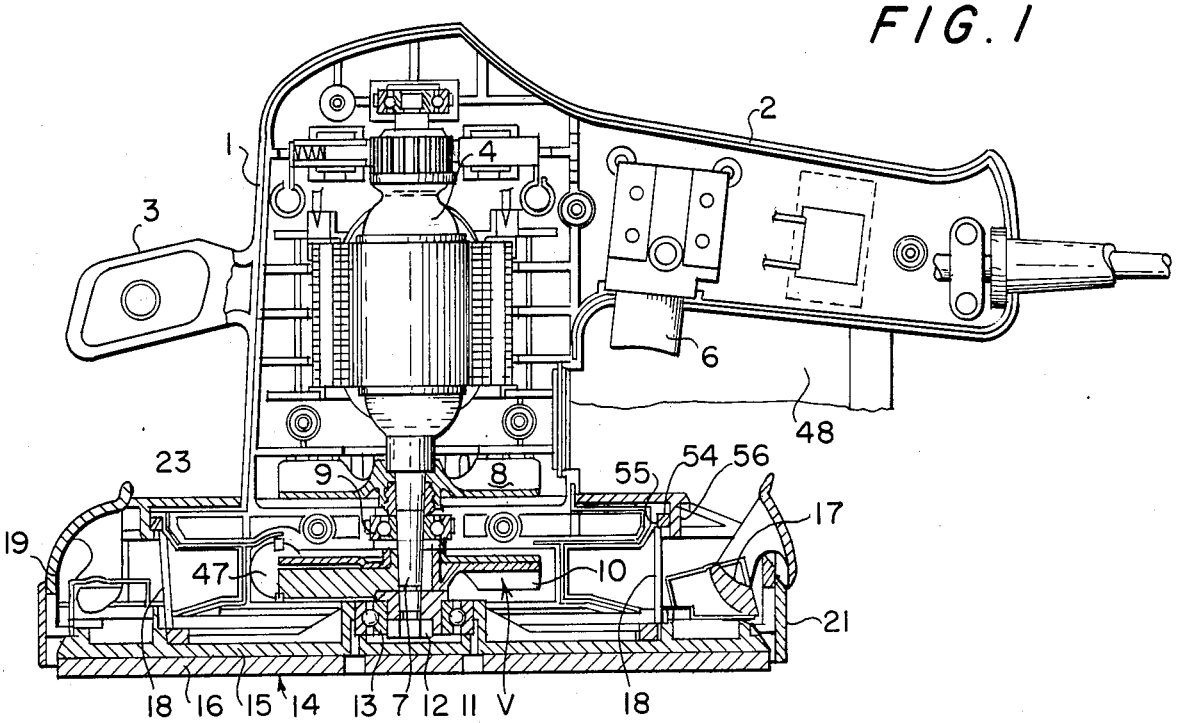
FIG. 1 is a vertical cross sectional view of an embodiment of a surface sander in accordance with the present invention.

The surface sander illustrated in the Figures comprises a motor housing 1, a handle 2, and a second handle 3 diametrically opposite handle 2. The motor housing accommodates an electric motor 4 powered by means of a cord 5, power being controlled by means of a switch 6 arranged in the handle 2. The control of the electric motor 4 is conventional and lies beyond the scope of this invention.

The motor 4 has a downwardly directed motor shaft 7, on which are arranged in order of succession from top to bottom the following elements:

A first ventilator 8 for transporting cooling air across the motor 4;

A bearing 9 supporting the motor shaft 7 near the lower end of the motor housing 1;

A second ventilator for dust extraction to be explained hereinafter and

An eccentric sleeve 11 fastened by means of a nut 12 to the end of the motor shaft 7.

The eccentric sleeve 11 is arranged in a bearing 13 of a sanding foot 14. The sanding foot 14 comprises a supporting layer 15, which may be made from metal or another appropriate material, for example, by a spray-casting process. To the underside of the supporting layer 15 is applied a resilient coating 16 of, for example, rubber, which serves to support an abrasive strip (not shown) to be positioned below the same. The abrasive strip has a rectangular shape, the short sides of which are clamped in fastening members 17 secured to the sanding foot 14.

The sanding foot 14 is suspensed by flexible means 18 to the lower end of the motor housing 1. Finally the dust hood 19 consisting of at least two parts and extending above and around the sanding foot 14 is arranged at the lower end of the motor housing 1.

Figure 2:
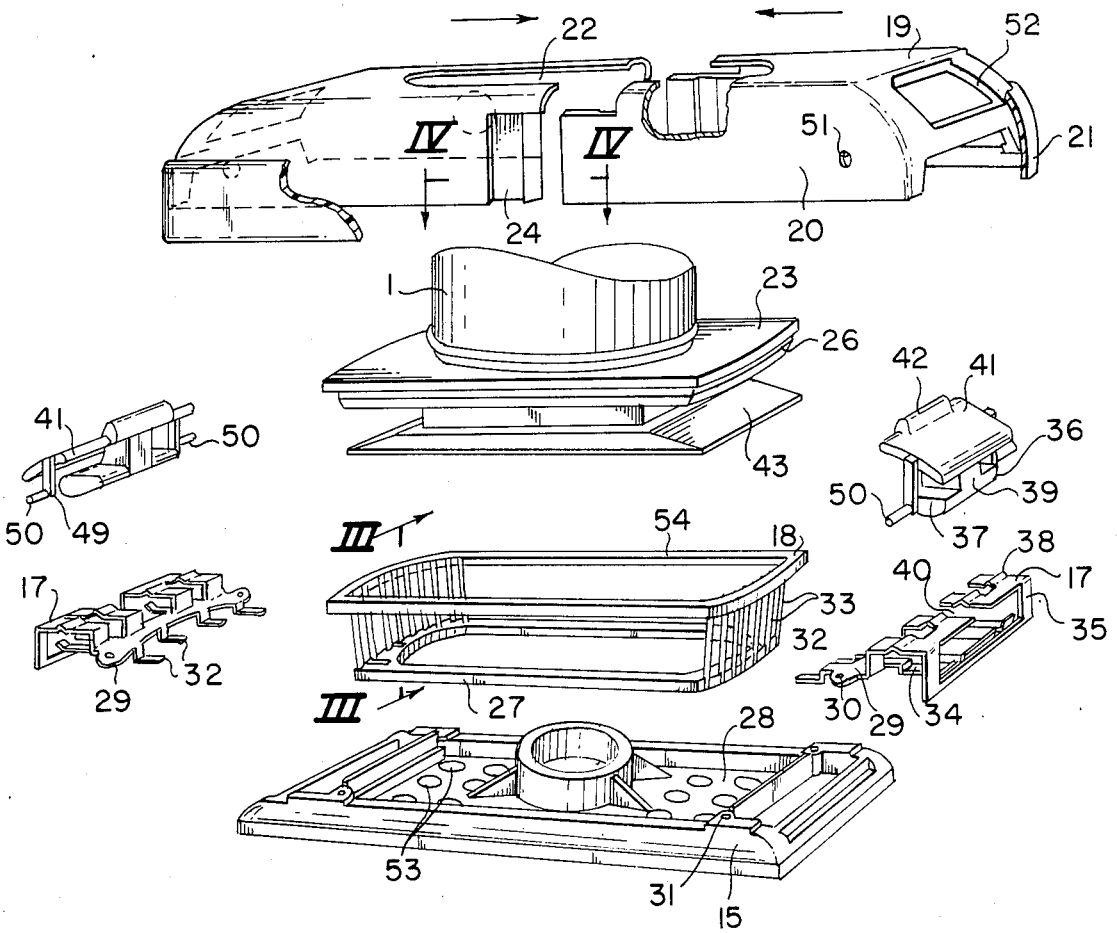
FIG. 2 is a perspective view of the disengaged parts for fastening the sanding foot to the motor housing.

Further details of the present invention and the mode of mounting will be explained further with reference to FIG. 2.

Figure 4:
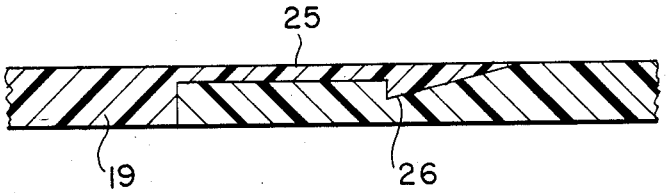
FIG. 4 is a cross section view taken on the line IV—IV in FIG. 2 of a joint between the two dust hood parts embodying the present invention.

In the embodiment shown the dust hood 19 comprises two sections of suitable material, for example, thermoplastic synthetic resin, while a flexible skirt 21 is fastened to the lower rim 20 of the sections. On the top side the sections have a recess 22, so that in the mounted state the two recesses are accurately located around the outer circumference of the motor housing part 1 (see FIG. 1). The motor housing 1 is provided with an outwardly projecting rim 23 for supporting the sections of the hood 19. The two sections are coupled with one another by locking means 24 near the vertical plane of separation between the two sections. FIG. 4 shows the cross-section of the locking means 24, one of the sections being provided with a lock bolt 25 snapping into a recess 26 of the other section. The lock bolt 25 has an inclined run-on face, so that when the sections 19 are pressed against one another a snap joint is established. This joint has a rigidity such that the entire sanding foot 14 can be secured to the housing by the shape of the flexible suspension members 18 to be described more fully hereinafter.

The flexible suspension means 18 has an annular top rim part 54 fitting into a circumferential groove 55 of the flange 23 of the motor housing 1. This rim part fits, moreover, in a groove 56 on the inner side of each section of the dust hood 19. It will be obvious that by mounting the dust hood sections 19 the rim part 54 of the flexible means is simultaneously clamped tight.

The flexible means 18 has a lower annular rim part 27 fitting in a depressed part 28 of the supporting layer 15 of the sanding foot. This rim part 27 is clamped by the fastening members 17 secured at both ends of the part 15 by means of a screw joint. For this purpose the fastening members 17 are provided with a strip 29 having a continuous hole 30 for passing a screw bolt which can be tightened in a tapped hole 31 of the part 15. The strip 29 is provided on the side remote from the fastening members 17 with tags 32, which clamp the lower rim part 27 in the depressed part 28.

Figure 3:
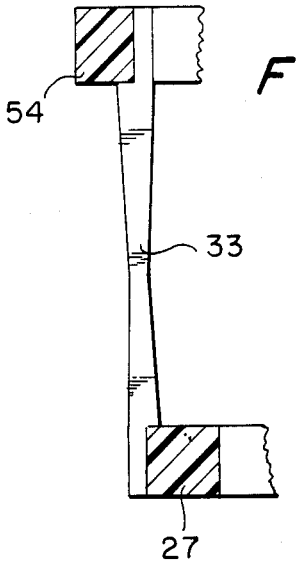
FIG. 3 is a vertical cross sectional view taken on the line III—III in FIG. 2 of the flexible suspension means between the sanding foot and motor housing.

According to the invention the flexible means is formed by tie strips or bars 33 between the top rim part 54 and the lower rim part 27, that is to say, only on the short side of the substantially rectangular shape of the rim parts. A section of the bar and the top and lower rim parts is shown in FIG. 3. It is apparent that the flexible means can be integrally manufactured, for example, from synthetic resin by spray-casting.

The fastening means 17 for the abrasive strip is formed by a pair of resilient clamping jaws which, together with the horizontal strip 29 and the tags 32, are made from the same piece of material. The free peripheral edges of the lower jaw part 34 and the upper jaw part 35 respectively are located near one another and serve as pinching edges for the abrasive strip to be arranged below the sanding foot 14.

The jaw parts 34 and 35 are spread by a spreading member 36 having a non-circular cross-section and fitting in the spreaded position by a rim 37 in a groove 38 in the upper jaw 35. The non-circular spreading body 36 has in its middle a shank 39, the width of which is smaller than the width of a recess 40 in the upper clamping jaw part 35. The shank 39 is fastened on the top side to a closing plate 41 having a control-lug 42.

Furthermore, the closing plate 41 is provided at each side edge with a downwardly directed arm 49 provided at the lower end with a laterally directed pivot pin 50. The pins 50 can snap into a hole or recess 51 of the hood part 19 so that the non-circular spreading body and the closing plate 41 are rotatable about the pins 50.

The motor housing 1 is prolonged on the underside of the flange part 23 in a dust guiding hood 43, the outer circumference substantially corresponding with the circumference of the depressed part 28 in the sanding foot 14. This prolonged part accommodates the second ventilator 10 for dust extraction.

Figure 5:
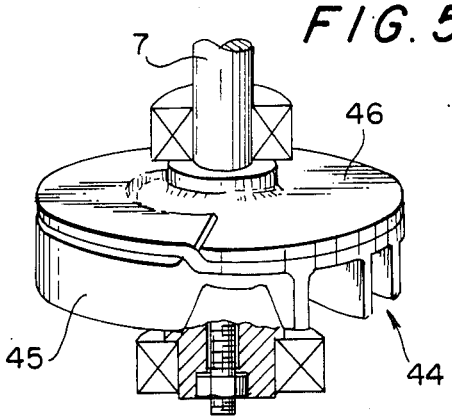
FIG. 5 is a perspective view of a ventilator impeller provided with counterweights in accordance with the present invention.

This ventilator comprises an impeller 44 (see FIG. 5), part of the radially directed blades of which are replaced by a counterweight 45. This counterweight 45 serves to eliminate the imbalance due to the oscillations of the sanding foot.

To avoid the dynamic imbalance on the driving shaft 7, (which imbalance is caused by the sanding foot and counterweight 45 attacking at different heights,) an additional counterweight 46 is arranged on the impeller at a higher level than the counterweight 45. Due to these two counterweights a substantially vibration free drive is ensured, which guarantees a long lifetime of the bearings of the driving shaft. Moreover, the ease of actuation is thus appreciably enhanced.

From FIG. 1 it is apparent that the dust hood 19 has an outlet port 47 for the abraded material, the port 47 being located approximately at the level of the impeller 44. To this outlet port 47 can be connected a dust bag 48.

From the foregoing it will be obvious that the surface sanding machine embodying present invention is composed of such a number of elements that mounting can be carried out in a very simple manner. For example it is only necessary to join and clamp the two hood parts 19 for mounting the whole sanding foot. In each hood part the plate 41 is mounted by means of the resilient pivotal arms.

Due to the end windows 52 in the hood parts 19 the actuation of the resilient clamping jaws 34 and 35 from the ouside remains possible by outwardly turning the lug 42 on the closing plate 41 blocking the window (see FIG. 1). The abrasive strip can be passed between the flexible circumferencial rim 21 of the hood part and the sanding foot as far as between the clamping jaws 34 and 35, after which the lug 42 can be tilted back, so that the clamping joint is established. This materially simplifies the actuation of the device.

The dust extraction is ensured since the abraded dust particles are sucked away between the gap around the sanding foot 14 and inside the flexible skirt and passed below the guide hood 43 of the motor housing 1. The end windows 52 are blocked by the closing plates 41, so that no fresh air is sucked in through the windows. The extraction is performed by the impeller 44, which propels the dust particles towards the outlet port 47. The extracted dust particles are collected in the dust bag 48. By extracting through preformed holes 53 in the foot plate 15, the skirt 21 may be dispensed with.

The present invention is not limited to the particular embodiment described above. The motor 4 may be powered from batteries arranged in the housing. The motor may, as a further alternative, be a hydraulic or pneumatic motor.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A surface sander comprising:

a housing having a handle;

a motor having a shaft extending therefrom and arranged in said housing;

a sanding foot having a bearing for receiving an end of said shaft so that said end of said shaft is eccentrically arranged in said bearing;

a dust collector hood comprising at least two mutually interlocking parts connected at a lower end of said housing and surrounding said sanding foot; and flexible means, contained in said dust collector hood, for connecting said sanding foot to said housing, said flexible means including an upper annular rim clamped between a rim formed on said lower end of said housing and said dust collector hood.

2. A sander as claimed in claim 1, wherein said flexible means further includes:

a lower annular rim connected to said sanding foot; and a plurality of spring strips for connecting said upper annular rim to said lower annular rim.

3. A sander as claimed in claim 2 wherein said flexible means comprises an integral spray-cast article.

4. A machine as claimed in claim 2, wherein the sanding foot is provided at oppposite ends thereof with fastening members for fastening a sanding strip to the sanding foot.

5. A sander as claimed in claim 4, wherein each fastening member has at least one protrusion for connecting said lower annular rim of said flexible means to said sanding foot.

6. A sander as claimed in claim 5, wherein each fastening member is constructed in the form of a pair of resilient clamping jaws for gripping said sanding strip.

7. A sander as claimed in claim 6, further comprising a spreading body for opening and closing said resilient clamping jaws.

8. A sander as claimed in claim 7, wherein the spreading body is rotatably supported in the dust collector hood.

9. A sander as claimed in claim 8, wherein, in the gripping position, the spreading body is free from contact with said jaws.

10. A sander as claimed in claim 8 wherein each hood part has a window through which the spreading body can be actuated.

11. A sander as claimed in claim 10, further comprising a closing plate connected to said spreading body for shutting each window.

12. A sander as claimed in claim 1, further comprising:

a first ventilator provided on said motor shaft for cooling said motor; and a second ventilator surrounded by said dust collector hood for exhausting dust from a sanding operation.

13. A sander as claimed in claim 12, further comprising an outlet port provided in a side of said dust collector hood through which dust is exhausted.

14. A sander as claimed in claim 13, wherein said second ventilator includes an impeller having part of the blades thereof replaced with a first counterweight for eliminating any imbalance due to operation of the sanding foot.

15. A sander as claimed in claim 14, wherein said second ventilator further includes a second counterweight located at a higher level than said first counterweight for reducing any imbalance on the motor shaft.

* * * * *